US009596538B2

(12) United States Patent
Anderson

(10) Patent No.: US 9,596,538 B2
(45) Date of Patent: Mar. 14, 2017

(54) WEARABLE AUDIO MIXING

(71) Applicant: Intel Corporation, Santa Clara, CA (US)

(72) Inventor: Glen J. Anderson, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 89 days.

(21) Appl. No.: 14/568,353

(22) Filed: Dec. 12, 2014

(65) Prior Publication Data

US 2016/0173982 A1 Jun. 16, 2016

(51) Int. Cl.

| | |
|---|---|
| ***H04R 29/00*** | (2006.01) |
| ***H04R 3/00*** | (2006.01) |
| *H04R 27/00* | (2006.01) |

(52) U.S. Cl.

CPC ..... *H04R 3/00* (2013.01); *H04R 27/00* (2013.01); *H04R 2201/023* (2013.01); *H04R 2227/003* (2013.01); *H04R 2420/01* (2013.01)

(58) Field of Classification Search

CPC H04R 27/00; H04R 2420/01; H04R 2420/07; H04R 2499/11; H04R 3/00; H04R 3/005; H04R 3/12; H04R 25/407; H04R 2227/003; H04R 29/00; H04L 12/1822; H04M 3/56; H04M 3/561; H04M 3/568

See application file for complete search history.

(56) References Cited

U.S. PATENT DOCUMENTS

| | | | | |
|---|---|---|---|---|
| 2004/0031379 | A1 | 2/2004 | Georges | |
| 2004/0102931 | A1 | 5/2004 | Ellis et al. | |
| 2006/0104347 | A1* | 5/2006 | Callan | H04N 7/15 375/240.01 |
| 2007/0283799 | A1* | 12/2007 | Carruthers | G10H 1/0083 84/645 |
| 2011/0021273 | A1 | 1/2011 | Buckley et al. | |
| 2014/0221040 | A1 | 8/2014 | De Moraes | |
| 2014/0233716 | A1* | 8/2014 | Villette | H04M 3/568 379/202.01 |
| 2014/0274178 | A1* | 9/2014 | Watanabe | H04B 7/24 455/507 |
| 2014/0328502 | A1* | 11/2014 | Virolainen | H04R 3/00 381/119 |

FOREIGN PATENT DOCUMENTS

| | | |
|---|---|---|
| WO | WO-2006085265 A2 | 8/2006 |
| WO | WO-2016094057 A1 | 6/2016 |

OTHER PUBLICATIONS

"International Application Serial No. PCT/US2015/061837, International Search Report mailed Mar. 4, 2016", 5 pgs.

(Continued)

*Primary Examiner* — Thang Tran

(74) *Attorney, Agent, or Firm* — Schwegman Lundberg & Woessner, P.A.

(57) ABSTRACT

Examples of systems and methods for mixing sounds are generally described herein. A method may include determining the identification of a plurality of worn devices, each of the plurality of worn devices assigned to a sound. The method may also include mixing the respective sounds of each of the plurality of worn devices to produce a mixed sound. The method may include playing the mixed sound.

24 Claims, 5 Drawing Sheets

(56) References Cited

OTHER PUBLICATIONS

"International Application Serial No. PCT/US2015/061837, Written Opinion mailed Mar. 04 2016", 6 pgs.
"Zoundz", Zizzle, [Online]. [Archived Nov. 4, 2006]. Retrieved from the Internet: <URL: https://web.archive.org/web/20061104210337/http://zizzle.com/zoundz.html>, (Archived: Nov. 4, 2006), 1 pg.
"Zoundz", Zizzle, [Online]. [Archived Oct. 5, 2006]. Retrieved from the Internet: <URL: https://web.archive.org/web/20061005025742/http://zizzle.com/zoundz.html>, (Archived: Oct. 5, 2006), 1 pg.
Firth, Simon, "HP Labs @ MTV: Researchers imagine the future of music, and more", HP Labs, [Online]. Retrieved from the Internet: <URL: http://www.hpl.hp.com/news/2004/oct_dec/djammer.html>, (Oct. 2004), 3 pgs.

* cited by examiner

WEARABLE AUDIO MIXING

BACKGROUND

Wearable devices are playing an increasingly important role in consumer technology. Wearable devices included wristwatches and wrist calculators, but recent wearable devices have become more varied and complex. Wearable devices are used for a variety of measurement activities like exercise tracking and sleep monitoring.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
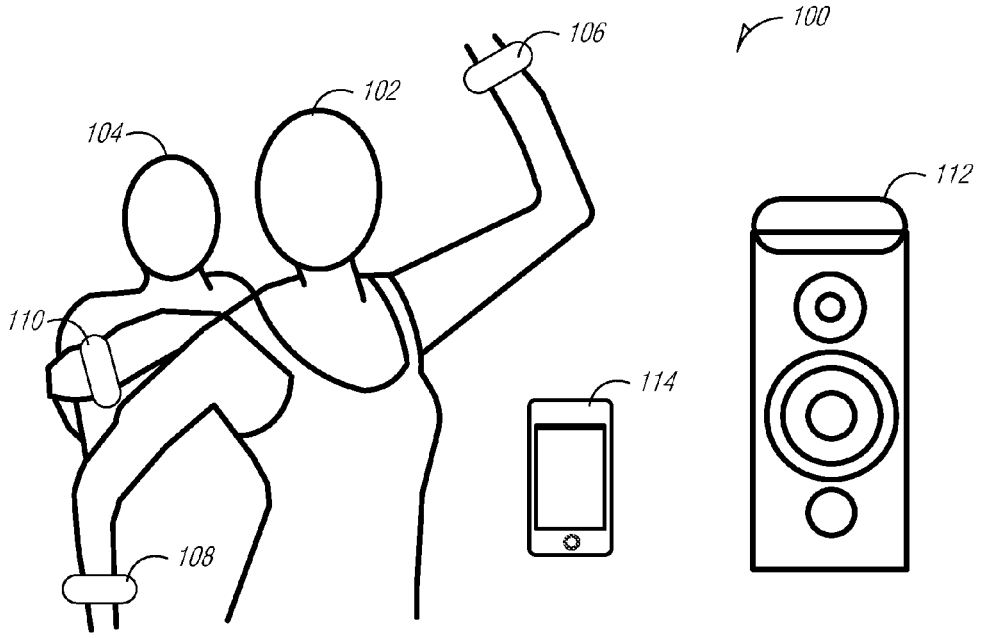
FIG. 1 is a schematic drawing illustrating environment including a system for playing mixed sounds, according to an embodiment.

Attributes of wearable devices may be used to determine sound attributes and the sound attributes may be mixed and played. Sound mixing has traditionally been done by humans, from as far back as composers to modern DJs in order to create a pleasant sound. With the advent of automatically tuned music and computing advances, machines have recently taken a bigger role in sound mixing.

This document describes the combination of wearable devices and sound mixing. A wearable device may be associated with a sound, such as a musical beat, instrument, riff, track, song, or the like. When a worn device is activated, the worn device, or another device, may play the associated sound. The associated sound may be played on a speaker or speaker system, headphones, earphones, or the like. The associated sound may be permanent for a wearable device, or changeable for the wearable device. The associated sound may update based on adjustments on a user interface, a purchased upgrade, a downloaded update, a level of achievement in a game or activity, a context, or other factors. Properties of the associated sound of a wearable device may be stored in memory on the wearable device or stored elsewhere, such as a sound mixing device, a remote server, the cloud, etc. The wearable device may store, or correspond to, a wearable device identification (ID), such as a serial number, barcode, name, or the like. The associated sound may be determined using the wearable device identification by a different device or system. The associated sound may be stored on the wearable device or elsewhere, such as a sound mixing device, a remote server, the cloud, a playback device, a music player, a computer, a phone, a tablet, etc.

In an example, a plurality of worn devices may be active in a wearable device sound system and each worn device in the plurality of worn device may be associated with a sound, which may be completely unique to each device, overlap in one or more properties or elements, or be the same as that of another device. One or more active devices from a plurality of worn devices may be used to create mixed sound. For example, the sound associated with a worn device may mix with a standard audio track automatically or a DJ may manipulate the associated sound and mix it with other sounds. The DJ may mix sounds associated with a plurality of wearable devices worn by a plurality of users. The DJ may select certain associated sounds while not using certain other associated sounds. The associated sound may be mixed automatically, such as by using heuristics for audio combining.

In another example, when two users are each wearing one or more wearable devices, the sounds associated with the one or more wearable devices may be mixed together. When the two users are in proximity to each other, such as within a certain radius, or physical contact occurs, through skin contact or capacitance clothing contact, alterations to the mixed sound may be made. The associated sounds may be altered based on electrical properties of a human body wearing the wearable device. For example, when a user is sweating, capacitance or heart rate may increase, which may be used to mix sound. Other factors may be used to mix sound, such as total body mass, proportion of fat, hydration levels, body heat, etc.

FIG. 1 shows a schematic drawing illustrating environment including a system for playing mixed sounds, according to an embodiment. In an example shown in FIG. 1, a sound mixing system 100 may include a user 102 wearing a first wearable device 106 and a second wearable device 108. In the sound mixing system 100 a user 104 may wear a third wearable device 110. In an example, a sound mixing system 100 may include a separate sound mixing device 114, such as a cell phone, tablet, computer, etc., or a speaker 112. Any of the three wearable devices 106, 108, or 110 may function as a sound mixing device, or the sound mixing may be done by a computer or other device not shown. The speaker 112 may be integrated into a speaker system or earphones or headphones may be used instead of or additionally to the speaker 112. The sound mixing system 100 may be used to determine identification of a plurality of worn devices, such as the first wearable device 106, the second wearable device 108, or the third wearable device 110. The sound mixing device 114 may determine identification of a single wearable device, such as the first wearable device 106 or a plurality of wearable devices, such as the first wearable device 106 and the second wearable device 108, for the user 102. The sound mixing device 114 may mix the respective sounds of each of the identified wearable devices to produce a mixed sound. The sound mixing device 112 may then send the mixed sound to the speaker 114 to play.

The sound mixing device 112 may detect a proximity between the first user 102 and the second user 104 and mix respective sounds of each of the worn devices of both users based on the proximity. The proximity may include a non-contact distance between the first user 102 and the second user 104, such as when the two users are within a specified distance of one another (e.g., within a few inches, one foot, one meter, 100 feet, the same club, the same city, etc.). The sound mixing device may alter the mixed sound when the non-contact distance changes. For example, if the distance between the first user 102 and the second user 104 increases, the mixed sound may become more discordant. In another example, the sound mixing device may be associated with the first user 102 as a primary user, and in this example, when the distance between the users increases, the mixed sound may be altered to include less of the sound associated with the third wearable device 110 on the second user 104 (e.g., few notes, softer sound, fading out, etc.). If the distance between the users decreases, the sound may be altered using opposing effects (e.g., less discordant, more notes, louder sound, fading in, etc.).

In an example, the proximity may include a physical contact point between the first user 102 and the second user 104. The sound mixing device may alter the mixed sound based on properties of the physical contact point. For example, the properties of the physical contact point may include detecting a change in a biometric signal, such as a capacitance, heart-rate, or the like, which may be measured by one or more of the wearable devices 106, 108, and 110. In another example, properties of the physical contact point may include an area, a duration, a strength of the physical contact, a location on the user, a location on conductive clothing, or the like. A property of the physical contact point may include a contact patch and the mixed sound may be altered based on the size of the contact patch. The point of physical contact may include contact between skin or conductive clothing of the first user 102 and skin or conductive clothing of the second user 104. Conductive clothing may include a conductive shirt, conductive gloves, or other conductive wearable attire. In another example, the physical contact point may include physical contact between two wearable devices.

The proximity may include a plurality of users dancing. The plurality of users may dancing may include a mixture of physical contact points and non-contact distance measurements. The mixed sound may be manipulated as the users dance, including altering the mixed sound based on various properties of the proximity of the plurality of users, such as duration, number of contact points, area of contact points, strength of contact pressure, rhythm, etc. Proximity may be detected using audio, magnets, Radio Frequency Identification (RFID), Near Field Communication (NFC), Bluetooth, Global Positioning System (GPS), Local Positioning System (LPS), using multiple wireless communication standards, including standards selected from 3GPP LTE, WiMAX, High Speed Packet Access (HSPA), Bluetooth, Wi-Fi Direct, or Wi-Fi standard definitions, or the like.

In another example, the mixed sound may be produced by any one of the wearable devices using any combination of sounds associated with any combination of wearable devices. For example, the first wearable device 106 may be used to mix the sound. The first wearable device 106 and may determine the identity of the second wearable device 108 and mix sound using associated sounds from the first wearable device 106 itself and the second wearable device 108. In this example, the first wearable device 106 may detect a proximity in a manner similar to that described above for the sound mixing device, including the various effects associated with contact, distance changes, and other properties of the sound mixing related to proximity.

In an example, sounds associated with a wearable device may include sounds corresponding to a specified instrument, such as a violin, guitar, drum, trumpet, vocals, etc. In another example, sounds associated with a wearable device may correspond to a specified timber, pitch, noise volume, instrument or vocal type (e.g., treble, baritone, bass, etc.), resonance, style (e.g., vibrato, slurred notes, pop, country, baroque, etc.), speed, frequency range, or the like. The sounds associated with a wearable device may include a series of notes, a melody, a harmony, scale, etc.

In an example, mixed sounds may be altered based on properties of a shape or color of an object. For example, a darker shade of a color (e.g., forest green as a darker color than neon green) may indicate a lower tone for a sound associated with the object, which may cause the mixed sound to incorporate a lower tone. In another example, different colors (e.g., red, blue, green, yellow, etc.) or shapes (e.g., square, cube, spiked, round, ovular, spherical, fuzzy, etc.) may correspond with a different sound, timber, pitch, volume, range, resonance, style, speed, or the like. An object may be detected by a camera, and properties of the object, such as shape or color may be determined. The properties may alter a sound mixed with sounds associated with wearable devices. Wearable devices including associated sounds may have a mixed sound which may be altered by gestures, of a user. The user may be wearing the wearable devices or the gestures may be determined by a camera from the user's point of view. Gestures may include motions or hand or arm signals. For example, a gesture of an arm raising from the waist upwards may indicate an increase in volume for the mixed sound. A sweeping gesture may indicate a change in the tone or type of mixed sound. Other gestures may be used to alter the mixed sound in any of the ways previously indicated for other mixed sound alterations. In another example, worn devices may be used to create gestures. Worn devices may have an accelerometer or other motion or acceleration monitoring aspect. For example, an accelerometer may be used to determine an acceleration of a wearable device and alter mixed sounds based on the acceleration, such as increasing tempo of the mixed sound when the worn device accelerates.

Figure 2:
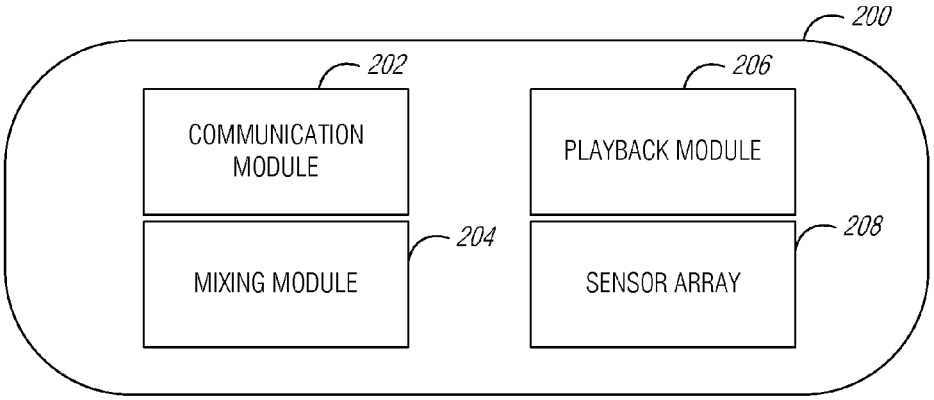
FIG. 2 is a schematic drawing illustrating a device for mixing sounds, according to an embodiment.

FIG. 2 shows a schematic drawing illustrating a device for mixing sounds, according to an embodiment. In an example, mixing sound may be done by a sound mixing device or wearable device 200. The sound mixing device or wearable device 200 may use various modules to mix the sound. For example, a communication module 202 may be used to determine identification of a plurality of worn devices, each of the plurality of worn devices assigned to a sound. The communication module 202 may also receive a biometric signal from each of the plurality of worn devices. In another example, the communication module 202 may receive an indication of a color or a shape of an object, an indication of a gesture of a user, or an acceleration of one of the plurality of worn devices or another object.

The sound mixing device or wearable device 200 may include a mixing module 204 to mix the respective sounds of each of the plurality of worn devices to produce a mixed sound. In an example, the mixing module 204 may detect a proximity between a first user and a second user and mix the respective sounds of each of the plurality of worn devices based on the proximity. The proximity may include any of the examples described above. The mixing module 204 may alter, change, remix, or mix sounds based on changes in proximity, including non-contact distance changes, physical contact point changes, or contact point changes. In another example, the mixing module 204 may alter, change, remix, or mix sounds based on properties of a color or a shape of an object, properties of a gesture of a user, or properties of an acceleration of a worn device or another object.

The sound mixing device or wearable device 200 may include a playback module 206 to play or record the mixed sound. The playback module 206 may include speakers, wires to send sound to speakers, a speaker system, earphones, headphones, or any other sound playback configuration. The playback module 206 may include a hard drive to store the recording of the mixed sound. In another example, a camera may record images or video of a user or from a user's point of view, and the images or video may be stored with the mixed sound. The images or video and mixed sound may be played together at a later time for the user to recreate the experience. The camera may be used to detect an object, and properties of the detected object may be determined and used to alter mixed sound, such as shape, size, color, texture, etc., of the object.

The wearable device 200 may include a sensor array 208. The sensor array 208 may detect a biometric signal, process a biometric signal, or send a biometric signal. A biometric signal may include a measurement or indication of a user's conductance, heart-rate, resistance, inductance, body mass, fat proportion, hydration level, or the like. A biometric signal may be used by the communication module to determine identification of a worn device. In another example, the biometric signal may be used as an indication that a worn device is active or should be used for a specified sound mixing. The sensor array may include a plurality of capacitive sensors, microphones, accelerometers, gyroscopes, heart-rate monitors, breath-rate monitors, etc.

In another example, a user interface may be included in a sound mixing system, such as on the wearable device 200, on the sound mixing device, a computer, phone, tablet, or the like. The user interface may include a music mixing application that the user may interact with to change or alter mixed sound. For example, the user may change tempo, rhythm, pitch, style of music, combination of sounds associated with a wearable device, or the like, using the user interface. The user interface may communicate with the mixing module 204 and the playback module 206 to alter the mixed sound and allow the new mixed sound to play. The user may use the user interface to activate or deactivate specified wearable devices, indicate a privacy mode, or turn the system on or off. The user interface may include features displayed to allow a user to assign sound properties to a wearable device, an object, a gesture, an acceleration, or specified properties of proximity to another user or another wearable device.

The wearable device 200 may include other components not shown. In an the wearable device 200 may include a wireless radio for communicating with a user interface device, a sound mixing device, or a speaker. In another example, the wearable device 200 may include short or long term storage (memory), a plurality of processors, or capacitive output capabilities.

Figure 3:
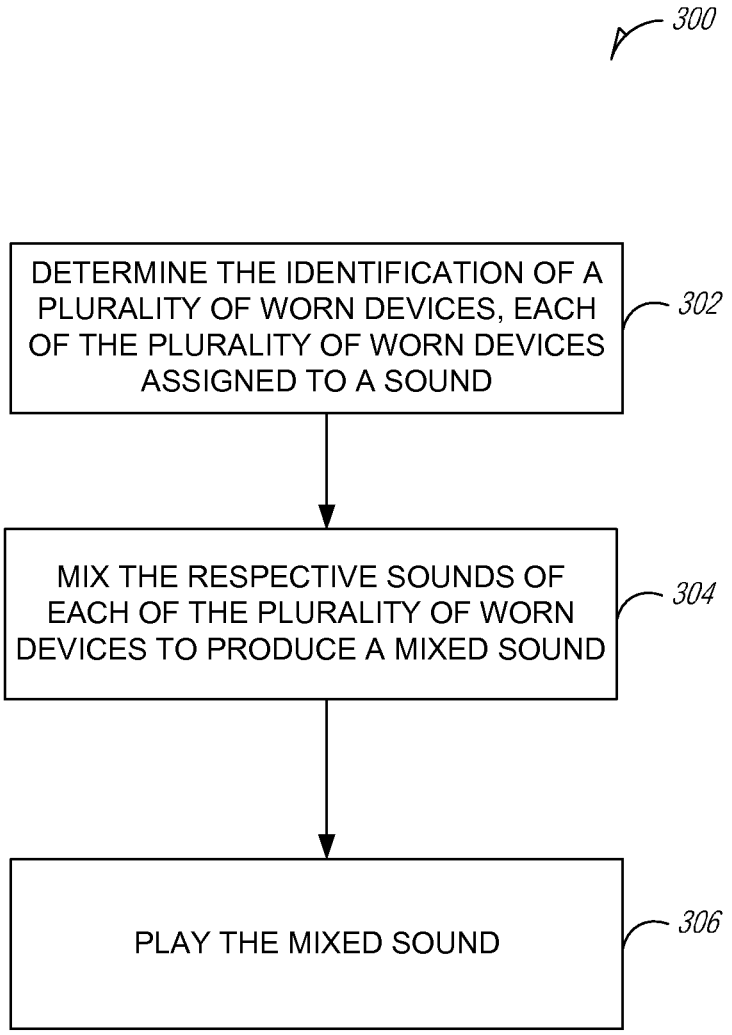
FIG. 3 is a flowchart illustrating a method for mixing sound, according to an embodiment.

FIG. 3 is a flowchart illustrating a method for mixing sound 300, according to an embodiment. The method for mixing sound 300 includes determining the identification of a plurality of worn devices, each of the plurality of worn devices assigned to a sound (operation 302). The plurality of worn devices may include a plurality of devices worn by a single user. In another example, the plurality of worn devices may include a one or more worn devices on a first user and one or more worn devices on a second user. The plurality of worn devices may include worn devices on a plurality of users. The method for mixing sound 300 may include mixing the respective sounds of each of the plurality of worn devices to produce a mixed sound (operation 304). The respective sounds may be unique, have overlapping properties, or be duplicative. The method for mixing sound 300 may include playing the mixed sound (operation 306).

In another example, a wearable device may be associated with a sound. A user may put on a first wearable device and the first wearable device may be activated automatically or by the user. The first wearable device may emit a first signal to indicate a first sound associated with the first wearable device. A sound mixing device may receive the first signal and play the first associated sound. The user may then put on a second wearable device, which may emit a second signal similar to the first signal to indicate a second sound associated with the second wearable device. The sound mixing device may receive the second signal, mix the first associated sound and the second associated sound and play the mixed sound. In another example, the first wearable device may receive the second signal, mix the first associated sound and the second associated sound, and send the mixed sound to the sound mixing device. The sound mixing device may then play the mixed sound. In another example, a second user may put on a third wearable device, and send a third signal to the sound mixing device, which may then mix all or some of the associated sounds.

Figure 4:
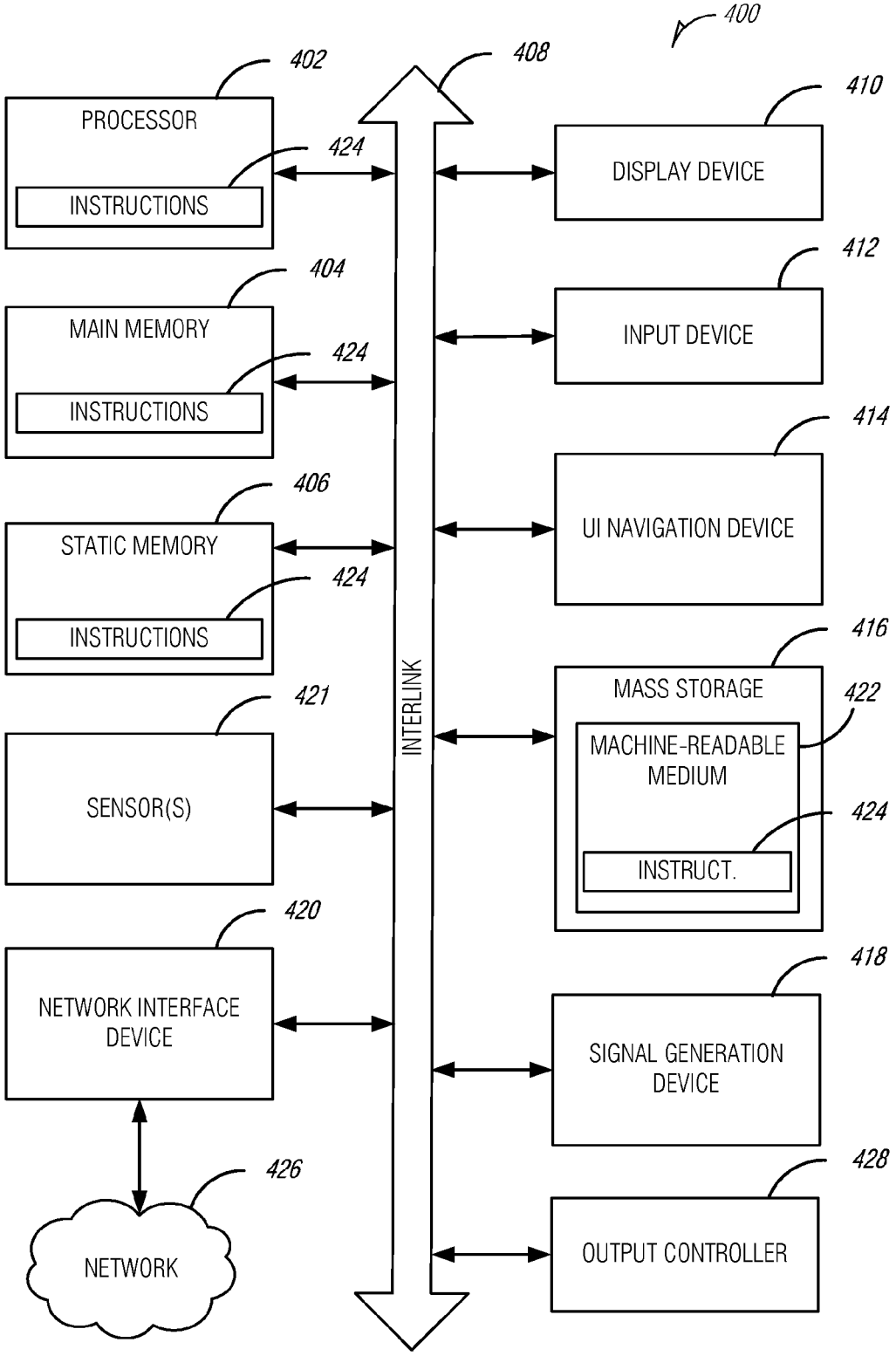
FIG. 4 is a block diagram illustrating an example machine upon which any one or more of the techniques (e.g., methodologies) discussed herein may perform, according to an example embodiment.

FIG. 4 is a block diagram of a machine 400 upon which one or more embodiments may be implemented. In alternative embodiments, the machine 400 can operate as a standalone device or can be connected (e.g., networked) to other machines. In a networked deployment, the machine 400 can operate in the capacity of a server machine, a client machine, or both in server-client network environments. In an example, the machine 400 can act as a peer machine in peer-to-peer (P2P) (or other distributed) network environment. The machine 400 can be a personal computer (PC), a tablet PC, a set-top box (STB), a personal digital assistant (PDA), a mobile telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

Examples, as described herein, can include, or can operate on, logic or a number of components, modules, or mechanisms. Modules are tangible entities (e.g., hardware) capable of performing specified operations when operating. A module includes hardware. In an example, the hardware can be specifically configured to carry out a specific operation (e.g., hardwired). In an example, the hardware can include configurable execution units (e.g., transistors, circuits, etc.) and a computer readable medium containing instructions, where the instructions configure the execution units to carry out a specific operation when in operation. The configuring can occur under the direction of the executions units or a loading mechanism. Accordingly, the execution units are communicatively coupled to the computer readable medium when the device is operating. In this example, the execution units can be a member of more than one module. For example, under operation, the execution units can be configured by a first set of instructions to implement a first module at one point in time and reconfigured by a second set of instructions to implement a second module.

Machine (e.g., a computer system) 400 can include a hardware processor 402 (e.g., a central processing unit (CPU), a graphics processing unit (GPU), a hardware processor core, or any combination thereof), a main memory 404 and a static memory 406, some or all of which can communicate with each other via an interlink (e.g., bus) 408.

The machine 400 can further include a display unit 410, an alphanumeric input device 412 (e.g., a keyboard), and a user interface (UI) navigation device 414 (e.g., a mouse). In an example, the display unit 410, alphanumeric input device 412 and UI navigation device 414 can be a touch screen display. The machine 400 can additionally include a storage device (e.g., drive unit) 416, a signal generation device 418 (e.g., a speaker), a network interface device 420, and one or more sensors 421, such as a global positioning system (GPS) sensor, compass, accelerometer, or other sensor. The machine 400 can include an output controller 428, such as a serial (e.g., universal serial bus (USB), parallel, or other wired or wireless (e.g., infrared (IR), near field communication (NFC), etc.) connection to communicate or control one or more peripheral devices (e.g., a printer, card reader, etc.).

The storage device 416 can include a machine readable medium 422 that is non-transitory on which is stored one or more sets of data structures or instructions 424 (e.g., software) embodying or utilized by any one or more of the techniques or functions described herein. The instructions 424 can also reside, completely or at least partially, within the main memory 404, within static memory 406, or within the hardware processor 402 during execution thereof by the machine 400. In an example, one or any combination of the hardware processor 402, the main memory 404, the static memory 406, or the storage device 416 can constitute machine readable media.

While the machine readable medium 422 is illustrated as a single medium, the term "machine readable medium" can include a single medium or multiple media (e.g., a centralized or distributed database, or associated caches and servers) configured to store the one or more instructions 424.

The term "machine readable medium" can include any medium that is capable of storing, encoding, or carrying instructions for execution by the machine 400 and that cause the machine 400 to perform any one or more of the techniques of the present disclosure, or that is capable of storing, encoding or carrying data structures used by or associated with such instructions. Non-limiting machine readable medium examples can include solid-state memories, and optical and magnetic media. In an example, a massed machine readable medium comprises a machine readable medium with a plurality of particles having invariant (e.g., rest) mass. Accordingly, massed machine-readable media are not transitory propagating signals. Specific examples of massed machine readable media can include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; and CD-ROM and DVD-ROM disks.

The instructions 424 can further be transmitted or received over a communications network 426 using a transmission medium via the network interface device 420 utilizing any one of a number of transfer protocols (e.g., frame relay, internet protocol (IP), transmission control protocol (TCP), user datagram protocol (UDP), hypertext transfer protocol (HTTP), etc.). Example communication networks can include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.11 family of standards known as Wi-Fi®, IEEE 802.16 family of standards known as WiMax®), IEEE 802.15.4 family of standards, peer-to-peer (P2P) networks, among others. In an example, the network interface device 420 can include one or more physical jacks (e.g., Ethernet, coaxial, or phone jacks) or one or more antennas to connect to the communications network 426. In an example, the network interface device 420 can include a plurality of antennas to wirelessly communicate using at least one of single-input multiple-output (SIMO), multiple-input multiple-output (MIMO), or multiple-input single-output (MISO) techniques. The term "transmission medium" shall be taken to include any intangible medium that is capable of storing, encoding or carrying instructions for execution by the machine 400, and includes digital or analog communication signals or other intangible medium to facilitate communication of such software.

Figure 5:
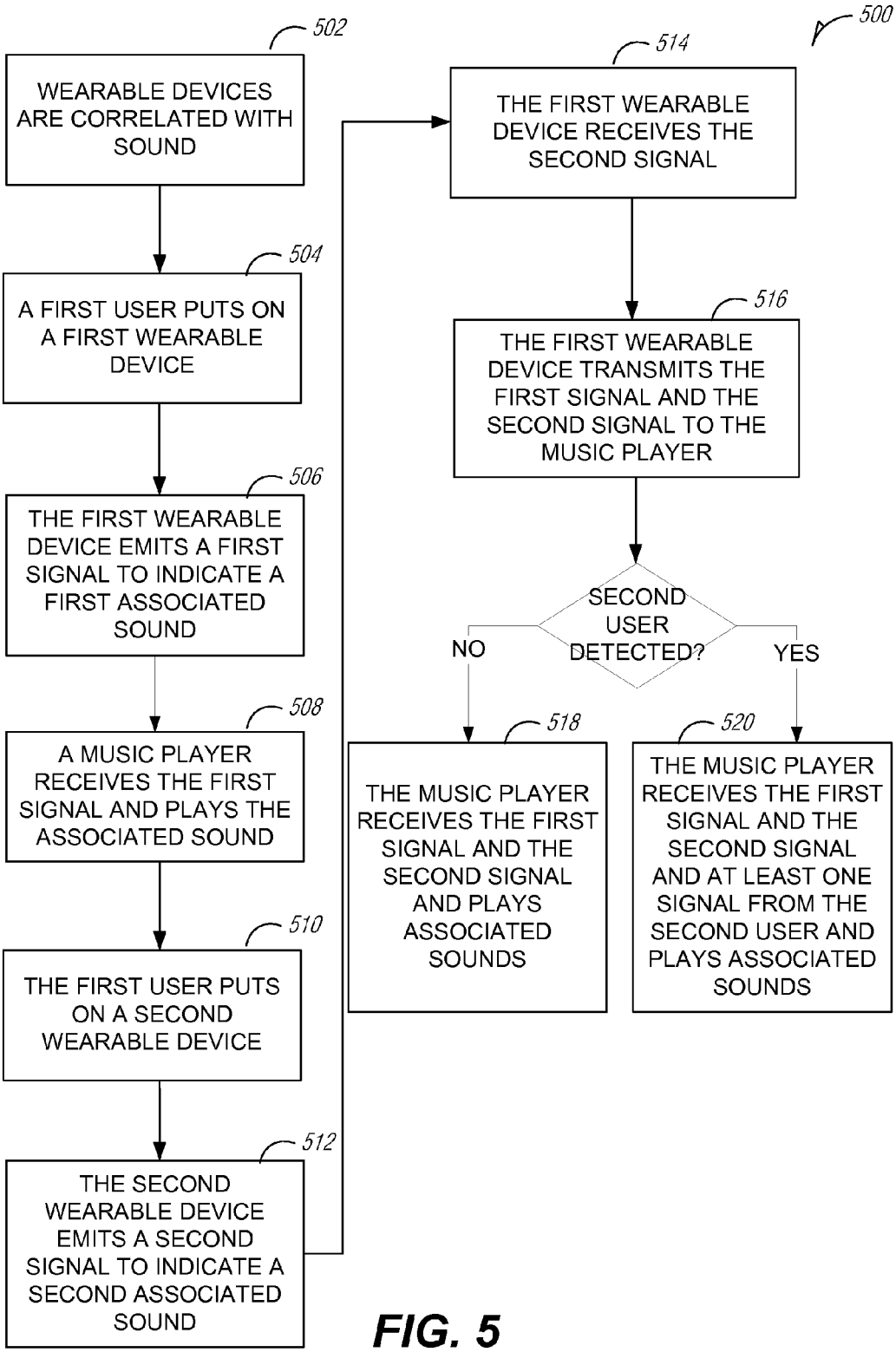
FIG. 5 is a flowchart illustrating a method for playing sound associated with wearable devices, according to an embodiment.

FIG. 5 is a flowchart illustrating a method 500 for playing sound associated with wearable devices, according to an embodiment. The method 500 may include an operation 502 to correlate wearable devices with sound. The method 500 includes an operation 504 for a first user to put on a first wearable device. The first wearable device may emit a first signal to indicate a first associated sound at operation 506 and a music player may receive the first signal and play the first associated sound at operation 508. The method 500 includes an operation 510 where the first user puts on a second wearable device or activates the second wearable device. The second wearable device may emit a second signal to indicate a second associated sound at operation 512. The method 500 may include an operation 514 for the first wearable device to receive the second signal. In another example, the second wearable device may receive the first signal from the first wearable device. The method 500 includes an operation 516 for the first wearable device to transmit the first signal and the second signal to the music player. To transmit the first signal and the second signal, the first wearable device may transmit a combined signal, separate signals, a new signal with information about the first signal and the second signal, etc. The method 500 may include a second user. When a second user is present, an operation 520 may include the music player receiving the first signal and the second signal and at least one signal from the second user and playing associated sounds. When the second user is not present, an operation 518 may include the music player receiving the first signal and the second signal and playing the associated sounds.

Figure 6:
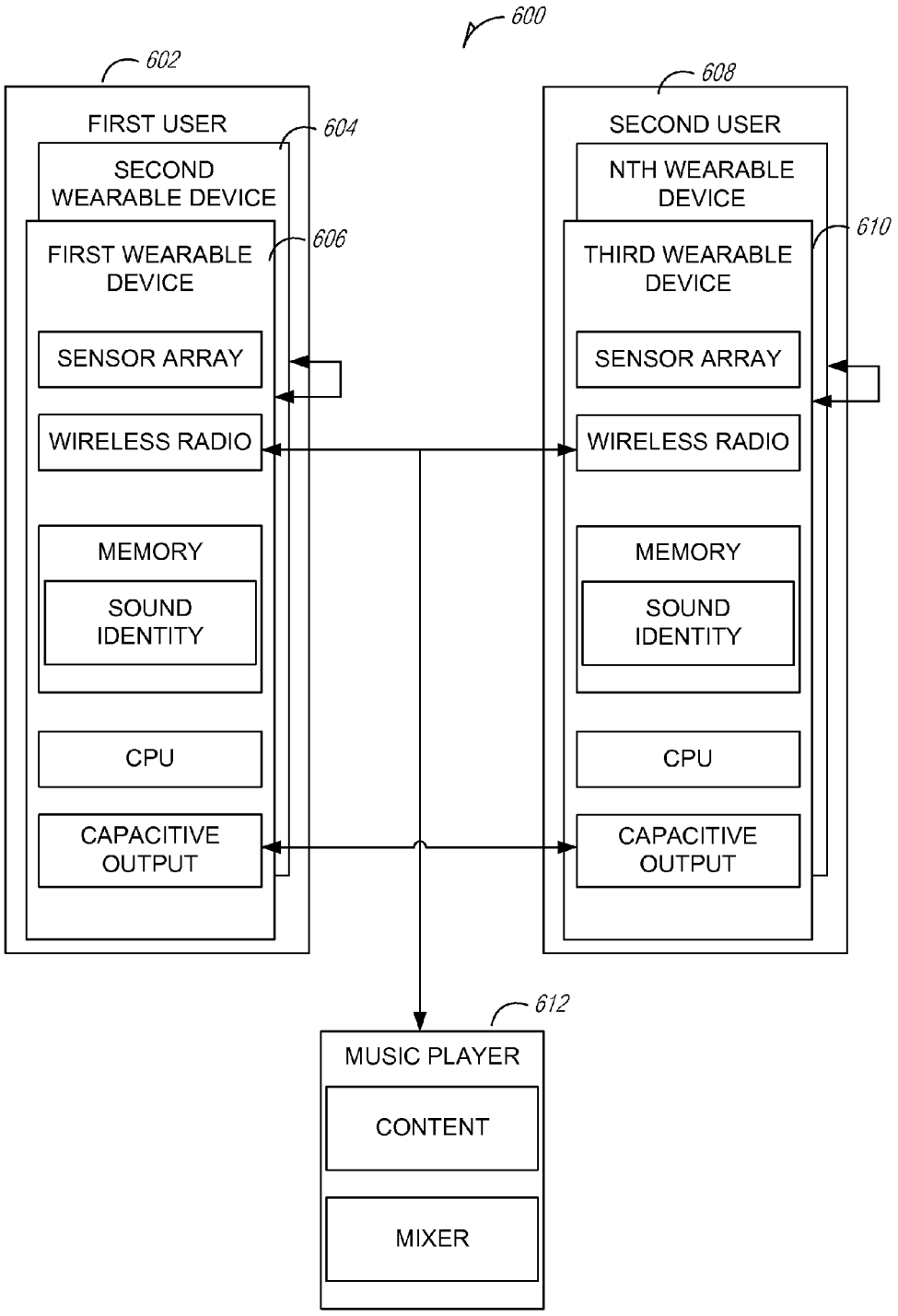
FIG. 6 is a block diagram illustrating an example wearable device system with a music player, according to an embodiment.

FIG. 6 is a block diagram illustrating an example wearable device system 600 with a music player, according to an embodiment. The system 600 may include a first user 602 wearing a first wearable device 606 and a second wearable device 604. In an example, the second wearable device 604 and the first wearable device 606 may send signals to each other using a wireless radio. A wearable device may include components similar to those shown in the first wearable device 606, such as a sensor array, a wireless radio, memory including a sound identity for the first wearable device 606, a central processing unit (CPU), or a capacitive output. The system may also include a second user 608 wearing a third wearable device 610 with components similar to the first wearable device 606. In an example, the third wearable device 610 may communicate with the first wearable device 606 using a wireless radio. The wireless radios on one or more of the wearable devices may also be used to communicate with a music player 612. The music player 612 may include content and a mixer to play the sound identified by the sound identity in memory on one or more wearable devices. The first wearable device 606 may also communicate with the second wearable device 604 or the third wearable device 610 using a capacitive output. The above example methods may be performed using the devices and components of system 600.

ADDITIONAL NOTES & EXAMPLES

Each of these non-limiting examples can stand on its own, or can be combined in various permutations or combinations with one or more of the other examples.

Example 1 includes the subject matter embodied by a sound mixing system comprising: a communication module to determine identification of a plurality of worn devices, each of the plurality of worn devices assigned to a sound, a mixing module to mix the respective sounds of each of the plurality of worn devices to produce a mixed sound, and a playback module to play the mixed sound.

In Example 2, the subject matter of Example 1 may optionally include wherein at least one of the plurality of worn devices is worn by a first user and at least one different one of the plurality of worn devices is worn by a second user, and wherein to mix the respective sounds, the mixing module is further to: detect a proximity between the first user and the second user, and mix the respective sounds of each of the plurality of worn devices based on the proximity.

In Example 3, the subject matter of one or any combination of Examples 1-2 may optionally include wherein the proximity is a non-contact distance between the first user and the second user.

In Example 4, the subject matter of one or any combination of Examples 1-3 may optionally include wherein when the non-contact distance changes, the mixing module is further to mix the respective sounds of each of the plurality of worn devices based on the change.

In Example 5, the subject matter of one or any combination of Examples 1-4 may optionally include wherein the proximity includes a physical contact point between the first user and the second user, and wherein to mix the respective sounds, the mixing module is further to alter the mixed sound based on properties of the physical contact point.

In Example 6, the subject matter of one or any combination of Examples 1-5 may optionally include wherein a property of the physical contact point includes a contact patch, and wherein to mix the respective sounds, the mixing module is further to alter the mixed sound based on a size of the contact patch.

In Example 7, the subject matter of one or any combination of Examples 1-6 may optionally include wherein the physical contact point includes physical contact between conductive clothing of the first user and the second user.

In Example 8, the subject matter of one or any combination of Examples 1-7 may optionally include wherein at least two of the plurality of worn devices are worn by the first user.

In Example 9, the subject matter of one or any combination of Examples 1-8 may optionally include wherein one of the at least two of the plurality of worn devices is assigned to a first frequency range and wherein the other of the at least two of the plurality of worn devices is assigned to a second frequency range.

In Example 10, the subject matter of one or any combination of Examples 1-9 may optionally include wherein to determine identification of the plurality of worn devices, the communication module is further to receive a biometric signal from a set of the plurality of worn devices.

In Example 11, the subject matter of one or any combination of Examples 1-10 may optionally include wherein the biometric signal includes at least one of a conductance measurement or a heart-rate measurement.

In Example 12, the subject matter of one or any combination of Examples 1-11 may optionally include wherein the communication module is further to receive an indication of a color of an object, and wherein to mix the respective sounds, the mixing module is further to alter the mixed sound based on properties of the color of the object.

In Example 13, the subject matter of one or any combination of Examples 1-12 may optionally include wherein the communication module is further to receive an indication of a shape of an object, and wherein to mix the respective sounds, the mixing module is further to alter the mixed sound based on properties of the shape of the object.

In Example 14, the subject matter of one or any combination of Examples 1-13 may optionally include wherein the communication module is further to receive an indication of a gesture of a user, and wherein to mix the respective sounds, the mixing module is further to alter the mixed sound based on the gesture.

In Example 15, the subject matter of one or any combination of Examples 1-14 may optionally include wherein the communication module is further to receive an indication of movement of one of the plurality of worn devices, and wherein to mix the respective sounds, the mixing module is further to alter the mixed sound based on properties of the movement.

In Example 16, the subject matter of one or any combination of Examples 1-15 may optionally include wherein the playback module is further to record the mixed sound.

Example 17 includes the subject matter embodied by a method of mixing sounds, the method comprising: determining identification of a plurality of worn devices, each of the plurality of worn devices assigned to a sound, mixing the respective sounds of each of the plurality of worn devices to produce a mixed sound, and playing the mixed sound.

In Example 18, the subject matter of Example 17 may optionally include wherein at least one of the plurality of worn devices is worn by a first user and at least one different one of the plurality of worn devices is worn by a second user, and wherein mixing the respective sounds comprises: detecting a proximity between the first and second user, and mixing the respective sounds of each of the plurality of worn devices based on the proximity.

In Example 19, the subject matter of one or any combination of Examples 17-18 may optionally include wherein the proximity is a non-contact distance between the first and second users.

In Example 20, the subject matter of one or any combination of Examples 17-19 may optionally include wherein when the non-contact distance changes, mixing the respective sounds is altered based on the change.

In Example 21, the subject matter of one or any combination of Examples 17-20 may optionally include wherein the proximity includes a physical contact point between the first and second users, and wherein mixing the respective sounds is altered based on properties of the physical contact point.

In Example 22, the subject matter of one or any combination of Examples 17-21 may optionally include wherein a property of the physical contact point includes a contact patch, and wherein mixing the respective sounds is altered based on a size of the contact patch.

In Example 23, the subject matter of one or any combination of Examples 17-22 may optionally include wherein the physical contact point includes physical contact between conductive clothing of the first user and the second user.

In Example 24, the subject matter of one or any combination of Examples 17-23 may optionally include wherein at least two of the plurality of worn devices is worn by the first user.

In Example 25, the subject matter of one or any combination of Examples 17-24 may optionally include wherein one of the at least two of the plurality of worn devices is assigned to a vocal sound and wherein the other of the at least two of the plurality of worn devices is assigned to a drum sound.

In Example 26, the subject matter of one or any combination of Examples 17-25 may optionally include wherein determining the identification includes receiving a biometric signal from each of the plurality of worn devices.

In Example 27, the subject matter of one or any combination of Examples 17-26 may optionally include wherein the biometric signal includes at least one of a conductance measurement or a heart-rate measurement.

In Example 28, the subject matter of one or any combination of Examples 17-27 may optionally include further comprising receiving an indication of a color of an object, and wherein mixing the respective sounds is altered based on the color of the object.

In Example 29, the subject matter of one or any combination of Examples 17-28 may optionally include further comprising receiving an indication of a shape of an object, and wherein mixing the respective sounds is altered based on the shape of the object.

In Example 30, the subject matter of one or any combination of Examples 17-29 may optionally include further comprising: identifying a gesture of a user, and wherein the mixing the respective sounds is altered based on properties of the gesture.

In Example 31, the subject matter of one or any combination of Examples 17-30 may optionally include further comprising: identifying a movement of one of the plurality of worn devices, and wherein mixing the respective sounds is altered based on properties of the movement.

In Example 32, the subject matter of one or any combination of Examples 17-31 may optionally include further comprising, recording the mixed sound.

In Example 33, the subject matter of one or any combination of Examples 17-32 may optionally include at least one machine-readable medium including instructions for receiving information, which when executed by a machine, cause the machine to perform any of the methods of Examples 17-32.

In Example 34, the subject matter of one or any combination of Examples 17-33 may optionally include an apparatus comprising means for performing any of the methods of Examples 17-32.

Example 35 includes the subject matter embodied by an apparatus for mixing sound comprising: means for determining identification of a plurality of worn devices, each of the plurality of worn devices assigned to a sound, means for mixing the respective sounds of each of the plurality of worn devices to produce a mixed sound, and means for playing the mixed sound.

In Example 36, the subject matter of Example 35 may optionally include wherein at least one of the plurality of worn devices is worn by a first user and at least one different one of the plurality of worn devices is worn by a second user, and wherein the means for mixing the respective sounds comprises: detecting a proximity between the first and second user, and mixing the respective sounds of each of the plurality of worn devices based on the proximity.

In Example 37, the subject matter of one or any combination of Examples 35-36 may optionally include wherein the proximity is a non-contact distance between the first and second users.

In Example 38, the subject matter of one or any combination of Examples 35-37 may optionally include wherein when the non-contact distance changes, the means for mixing the respective sounds includes altering the mixed sound based on the change.

In Example 39, the subject matter of one or any combination of Examples 35-38 may optionally include wherein the proximity includes a physical contact point between the first and second users, and wherein the means for mixing the respective sounds includes altering the mixed sound based on properties of the physical contact point.

In Example 40, the subject matter of one or any combination of Examples 35-39 may optionally include wherein a property of the physical contact point includes a contact patch, and wherein the means for mixing the respective sounds includes altering the mixed sound based on a size of the contact patch.

In Example 41, the subject matter of one or any combination of Examples 35-40 may optionally include wherein the physical contact point includes physical contact between conductive clothing of the first user and the second user.

In Example 42, the subject matter of one or any combination of Examples 35-41 may optionally include wherein at least two of the plurality of worn devices is worn by the first user.

In Example 43, the subject matter of one or any combination of Examples 35-42 may optionally include wherein one of the at least two of the plurality of worn devices is assigned to a frequency range and wherein the other of the at least two of the plurality of worn devices is assigned to a percussive sound.

In Example 44, the subject matter of one or any combination of Examples 35-43 may optionally include wherein the means for determining the identification includes receiving a biometric signal from each of the plurality of worn devices.

In Example 45, the subject matter of one or any combination of Examples 35-44 may optionally include wherein the biometric signal includes at least one of a conductance measurement or a heart-rate measurement.

In Example 46, the subject matter of one or any combination of Examples 35-45 may optionally include further comprising means for receiving an indication of a color of an object, and wherein the means for mixing the respective sounds includes altering the mixed sound based on the color of the object.

In Example 47, the subject matter of one or any combination of Examples 35-46 may optionally include further comprising means for receiving an indication of a shape of an object, and wherein the means for mixing the respective sounds includes altering the mixed sound based on the shape of the object.

In Example 48, the subject matter of one or any combination of Examples 35-47 may optionally include further comprising: identifying a gesture of a user, and wherein the means for mixing the respective sounds includes altering the mixed sound based on properties of the gesture.

In Example 49, the subject matter of one or any combination of Examples 35-48 may optionally include further comprising: identifying a movement of one of the plurality of worn devices, and wherein the means for mixing the respective sounds includes altering the mixed sound based on properties of the movement.

In Example 50, the subject matter of one or any combination of Examples 35-49 may optionally include further comprising, recording the mixed sound.

The above detailed description includes references to the accompanying drawings, which form a part of the detailed description. The drawings show, by way of illustration, specific embodiments which can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the embodiments should be determined with reference to the appended claims, along with the full scope of equivalents to which such claims are entitled.

What is claimed is:

1. A sound mixing system comprising:

a communication module to determine identification of a plurality of worn devices, each of the plurality of worn devices assigned to a sound, wherein to determine identification of the plurality of worn devices, the communication module is further to receive a biometric signal from each of the plurality of worn devices;

a mixing module to mix the respective sounds of each of the identification determined worn devices to produce a mixed sound; and a playback module to play the mixed sound.

2. The system of claim 1, wherein at least one of the plurality of worn devices is worn by a first user and at least one different one of the plurality of worn devices is worn by a second user, and wherein to mix the respective sounds, the mixing module is further to:

detect a proximity between the first user and the second user; and mix the respective sounds of each of the plurality of worn devices based on the proximity.

3. The system of claim 2, wherein the proximity is a non-contact distance between the first user and the second user.

4. The system of claim 2, wherein the proximity includes a physical contact point between the first user and the second user, and wherein to mix the respective sounds, the mixing module is further to alter the mixed sound based on properties of the physical contact point.

5. The system of claim 4, wherein a property of the physical contact point includes a contact patch, and wherein to mix the respective sounds, the mixing module is further to alter the mixed sound based on a size of the contact patch.

6. The system of claim 4, wherein the physical contact point includes physical contact between conductive clothing of the first user and the second user.

7. The system of claim 1, wherein the biometric signal includes at least one of a conductance measurement or a heart-rate measurement.

8. The system of claim 1, wherein the communication module is further to receive an indication of a color of an object, and wherein to mix the respective sounds, the mixing module is further to alter the mixed sound based on properties of the color of the object.

9. The system of claim 1, wherein the communication module is further to receive an indication of a shape of an object, and wherein to mix the respective sounds, the mixing module is further to alter the mixed sound based on properties of the shape of the object.

10. The system of claim 1, wherein the communication module is further to receive an indication of a gesture of a user, and wherein to mix the respective sounds, the mixing module is further to alter the mixed sound based on properties of the gesture.

11. The system of claim 1, wherein the communication module is further to receive an indication of a movement of one of the plurality of worn devices, and wherein to mix the respective sounds, the mixing module is further to alter the mixed sound based on properties of the movement.

12. The system of claim 1, wherein the playback module is further to record the mixed sound.

13. A method of mixing sounds, the method comprising:

determining identification of a plurality of worn devices, each of the plurality of worn devices assigned to a sound, wherein determining identification of the plurality of worn devices, includes receiving a biometric signal from each of the plurality of worn devices;

mixing the respective sounds of each of the identification determined worn devices to produce a mixed sound; and playing the mixed sound.

14. The method of claim 13, wherein at least one of the plurality of worn devices is worn by a first user and at least one different one of the plurality of worn devices is worn by a second user, and wherein mixing the respective sounds comprises:

detecting a proximity between the first and second user; and mixing the respective sounds of each of the plurality of worn devices based on the proximity.

15. The method of claim 14, wherein the proximity is a non-contact distance between the first and second users.

16. The method of claim 14, wherein the proximity includes a physical contact point between the first and second users, and wherein mixing the respective sounds is altered based on properties of the physical contact point.

17. The method of claim 16, wherein a property of the physical contact point includes a contact patch, and wherein mixing the respective sounds is altered based on a size of the contact patch.

18. The method of claim 13, further comprising:

identifying a gesture of a user; and wherein the mixing the respective sounds is altered based on properties of the gesture.

19. The method of claim 13, further comprising:

identifying a movement of one of the plurality of worn devices; and wherein mixing the respective sounds is altered based on properties of the movement.

20. At least one machine-readable medium including instructions for receiving information, which when executed by a machine, cause the machine to:

determine identification of a plurality of worn devices, each of the plurality of worn devices assigned to a sound, wherein to determine identification of the plurality of worn devices, includes instructions to receive a biometric signal from each of the plurality of worn devices;

mix the respective sounds of each of the identification determined worn devices to produce a mixed sound; and play the mixed sound.

21. The at least one machine-readable medium of claim 20, wherein at least one of the plurality of worn devices is worn by a first user and at least one different one of the plurality of worn devices is worn by a second user, and wherein operations to mix the respective sounds comprise:

operations to detect a proximity between the first and second user; and operations to mix the respective sounds of each of the plurality of worn devices based on the proximity.

22. The at least one machine-readable medium of claim 21, wherein the proximity is a non-contact distance between the first and second users.

23. The at least one machine-readable medium of claim 21, wherein the proximity includes a physical contact point between the first and second users, and wherein operations to mix the respective sounds are altered based on properties of the physical contact point.

24. The at least one machine-readable medium of claim 23, wherein a property of the physical contact point includes a contact patch, and wherein operations to mix the respective sounds are altered based on a size of the contact patch.

* * * * *